US007431780B2

(12) United States Patent
Myhr et al.

(10) Patent No.: US 7,431,780 B2
(45) Date of Patent: Oct. 7, 2008

(54) METHOD AND APPARATUS FOR DISTORTING A WORKPIECE

(75) Inventors: Ole Runar Myhr, Raufoss (NO); Børge Bjørneklett, Gjøvik (NO)

(73) Assignee: Norsk Hydro Asa, Oslo (NO)

( * ) Notice: Subject to any disclaimer, the term of this patent is extended or adjusted under 35 U.S.C. 154(b) by 558 days.

(21) Appl. No.: 10/485,646

(22) PCT Filed: Jul. 19, 2002

(86) PCT No.: PCT/NO02/00268

§ 371 (c)(1),
(2), (4) Date: May 17, 2004

(87) PCT Pub. No.: WO03/011493

PCT Pub. Date: Feb. 13, 2003

(65) Prior Publication Data

US 2004/0237622 A1 Dec. 2, 2004

(30) Foreign Application Priority Data

Aug. 3, 2001 (GB) ..... 0119023.0

(51) Int. Cl.
*B21D 37/16* (2006.01)

(52) U.S. Cl. ..... 148/508; 72/342.94

(58) Field of Classification Search ..... 148/508; 72/342.94

See application file for complete search history.

(56) References Cited

U.S. PATENT DOCUMENTS

| | | | | |
|---|---|---|---|---|
| 5,737,957 | A | 4/1998 | Gray | |
| 5,778,151 | A | 7/1998 | Gramckow et al. | |
| 6,385,556 | B1 | 5/2002 | Kawano et al. | |
| 6,675,625 | B1 * | 1/2004 | Roche et al. | 72/342.94 |
| 2004/0237622 | A1 * | 12/2004 | Myhr et al. | 72/342.94 |

FOREIGN PATENT DOCUMENTS

| | | |
|---|---|---|
| EP | 0 904 866 | 3/1999 |
| JP | 60-231524 | 11/1985 |
| JP | 62-134118 | 6/1987 |
| JP | 6-541 | 1/1994 |
| JP | 6-226360 | 8/1994 |
| JP | 9-155458 | 6/1997 |
| JP | 10-277650 | 10/1998 |
| JP | 11-19724 | 1/1999 |
| JP | 2000-94044 | 4/2000 |
| WO | 99/44764 | 9/1999 |

* cited by examiner

*Primary Examiner*—Scott Kastler
(74) *Attorney, Agent, or Firm*—Wenderoth, Lind & Ponack, L.L.P.

(57) ABSTRACT

The method of distorting a workpiece (8) includes selecting a desired configuration of the workpiece; determining distortions (14) to be applied to at least two regions of the workpiece to cause the workpiece to adopt the desired configuration; and using the determined distortions in accordance with predetermined information (12,13) relating heat treatments of the workpiece to resultant distortions, to obtain or generate heat control data (15) defining heat treatments to be applied to corresponding regions of the workpiece, which will cause the determined distortions in the workpiece (8). The heat control data and the determined distortions are related by the equation AX=B, where B is a vector describing the determined distortions according to the heat treatments, X is a vector representing the heat control data and A is a matrix of elements representing the predetermined information. The defined heat treatments are then applied (16) to the corresponding regions of the workpiece (8) to produce the determined distortions.

29 Claims, 5 Drawing Sheets

METHOD AND APPARATUS FOR DISTORTING A WORKPIECE

TECHNICAL FIELD OF THE INVENTION

The present invention relates to a method and apparatus for distorting a workpiece, and for example, for correcting distortions produced in a workpiece during its manufacture.

BACKGROUND TO THE INVENTION

In many engineering applications components are fabricated using a range of processing techniques. The techniques used are dependent upon the material from which the components are constructed and their intended application. For example, engineering components fabricated from metals and alloys are often processed using techniques such as extrusion, forging, drawing, bending, rolling and casting. Whilst these processes are often essential to produce a resultant component with the desired geometry, it is often difficult to produce components with dimensional geometries having sufficient accuracy to meet the engineering requirements.

This is because each of these processes may inherently cause dimensional deviations from those nominally required. Such distortions occur particularly in complex manufacturing processes where a number of individual processes are used serially in the fabrication of components.

Some minor distortions can be accommodated by engineering tolerances although in many cases the high tolerances required make further processing of the components essential in order to correct these distortions.

As an example, in the automotive industry high performance vehicles are often fabricated using a number of lightweight and high strength components using materials such as aluminium alloys. These components range from minor parts, to major members of vehicle bodies. In many cases these components are formed using extrusion techniques. Typical tolerances required in such applications are dimensional accuracies within 0.2 millimeters. These usually cannot be achieved using conventional forming processes such as extrusion.

At present the geometrical variations of formed components are provided with maximum dimensional accuracy by using well trimmed tooling and close control of the process parameters. If, however, this is insufficient to keep the dimensions within acceptable limits, some form of correction processing must be applied to the components in order to correct their geometry. Conventional methods for correcting such geometries are based on mechanical techniques where the components are mechanically deformed, cut or milled to produce the necessary corrections.

There are a number of major problems with the use of these correction processes. For example, the apparatus used to perform them is often extremely expensive and only has limited application for particular purposes. This is particularly costly where the number of components produced during a production run is small, as might be the case in the production of components for a high performance sports car. As the associated correction apparatus will usually be specifically designed for correcting a particular component, this adds great cost to the production of the component as a whole. Furthermore it may be inconvenient or even impossible to correct the geometry in certain regions of the component as access to the region in question may be very limited.

There is therefore an object of the present invention to provide a more versatile method of correcting such distortions in component workpieces.

In WO99/44764, a system is described which includes a database of data relating to the forming of plates, from which further data are inferred in the determination of appropriate heat treatments for plate forming.

SUMMARY OF THE INVENTION

In accordance with a first aspect of the present invention we provide a method of distorting a workpiece comprising:

selecting a desired configuration of the workpiece;

determining distortions to be applied to at least two regions of the workpiece to cause the workpiece to adopt the desired configuration;

using the determined distortions in accordance with predetermined information relating heat treatments of the workpiece to resultant distortions, to obtain or generate heat control data defining heat treatments to be applied to corresponding regions of the workpiece, which will cause the determined distortions in the workpiece, wherein the heat control data and the determined distortions are related by the equation AX=B, where B is a vector describing the determined distortions according to the heat treatments, X is a vector representing the heat control data and A is a matrix of elements representing the predetermined information; and applying the defined heat treatments to the corresponding regions of the workpiece to produce the determined distortions.

We have realised that by carefully analysing the way in which heat treatments cause the resultant distortions in two or more regions of a workpiece, this information can then be used to select and apply suitable heat treatments to the workpiece in a controlled manner in order to produce the desired distortions. Typically such distortions take the form of dimensional adjustment and/or forming of the workpiece.

One particular application of this is in the correction of distortions which occur in workpieces due to fabrication processes. However, the invention can also be used for deliberately producing desired dimensions or shapes rather than only as a corrective technique.

The invention is therefore applicable to multiple heat treatment positions in order to produce corresponding multiple distortions. There is a need to be able to address multiple distortion problems as it is these problems that normally occur in practical workpieces. One advantage of using a relationship between distortions and heat treatments, constrained by the matrix equation AX=B, is that the desired vector X representing the suitable heat treatments can be rapidly evaluated. This is important in many applications where mass produced workpieces result in many types of distortions which each require rapid correction, preferably performed by a single apparatus.

The speed increase derives directly from the use of the matrix equation. This approach is therefore faster and simpler than attempting to determine complex relationships from a range of experimental data.

A second important advantage is that by careful consideration and selection of suitable predetermined data which complements the matrix equation structure, a high degree of accuracy can be achieved between the predicted and calculated effects of the heat treatment. For example the predetermined data can be chosen to relate heat treatments to distortions at the exact positions where distortions will be required in practice. This produces a more accurate solution and the quantity of predetermined data needed is greatly reduced, giving savings in the amount of modelling or experimentation required to produce such data.

The present invention therefore offers wide ranging advantages in allowing accurate, cost efficient and rapid application of distortions to workpieces such as engineering components and parts. A further benefit of producing distortions using heat treatments is that the same apparatus can be used for a large number of different products rather than the conventional methods such as bending and stretching that are currently used.

By generating a full understanding of the behaviour of the workpiece and the heat treatment, and coupling this with a high degree of control of local heating, it is possible to produce complex distortions in many different workpiece geometries which would be very difficult to achieve by traditional mechanical techniques.

The technique can be used in any material which undergoes expansion and plastic deformation upon heating. There are therefore a wide range of applications for this, although particular advantages are found in metallic materials such as aluminium and/or steel. Specifically, a major advantage is provided by the invention in the distortion of workpieces formed from high thermal conductivity materials such as aluminium alloys. This is particularly the case where workpieces with non-planar profiles are used, that is those having hollow or partially enclosed profiles allowing the generation of suitable thermal gradients.

In the present invention in general, the application of heat will not produce wear within the apparatus, particularly as the heat source may not even contact the workpiece.

In many cases some initial determination of the workpiece configuration is desirable and therefore the method preferably further comprises determining an initial configuration of the workpiece.

There are many ways in which the predetermined information relating heat treatments to the resultant workpiece distortions may be obtained and the method preferably further comprises generating this predetermined information. In some cases this involves directly generating a relationship between heat treatments of the workpiece and resultant distortions, for example using analytical equations representing the physics of the system.

Alternatively, predetermined data can be generated to relate these, and this generally involves a systematic analysis of the distortion effects of various heat treatments, for example by varying one variable defining the heat treatment, such as the heat input. To do this, a series of physical experiments can be performed and the corresponding data obtained can be recorded for later use.

Typically, the data obtained comprise heat treatment data representing a variation of values of at least one variable defining the heat treatment, and distortion data representing the corresponding degree of distortion within the workpiece.

Preferably however, the heat treatment data and/or the distortion data are generated by modelling the application of heat treatments to the workpiece. This avoids the necessity for costly and time-consuming experiments.

A range of modelling techniques can be used to generate the predetermined data, such as those based upon simple engineering and heat flow equations. In this case the predetermined information (data) represents the solution to these equations.

Whilst simple models are suitable for simple workpiece geometries, more detailed and accurate modelling techniques are typically used for complex workpiece geometries. A finite elements technique is preferably used to achieve this complex workpiece modelling. By providing a finite element model with thermal and mechanical data relating to the material in question, accurate predictions of the distortions within workpieces can be made. In addition, for alloy systems, composition and microstructural data can be considered within the model to improve the accuracy of the distortion predictions.

The data produced by a finite element model (FEM) describing the heat treatments and distortions may take a variety of forms. Typically this distortion data describes a distortion angle between two parts of the workpiece on opposing sides of the region to which the heat is applied. Typically the heat treatment data defines at least one of, the total heat input of the heat treatment, the intensity or intensity distribution of the heat source, the area over which the heat source is acting, the travel speed or the time period during which the heat is applied.

In general the FEM produces a data set describing the distortion behaviour of the workpiece resulting from various heat treatments and the applied boundary conditions such as for example fixture and clamping means.

The data produced by the modelling are preferably then further modelled to establish a relationship between the heat treatments and distortions, for later use in defining suitable heat treatments (in terms of heat control data) to apply to the workpiece. Typically a generalised relationship is therefore determined for the selection of an appropriate heat treatment, given a particular desired distortion.

The model chosen will depend upon the target data and may be a simple linear equation (normally including an offset) or more complicated equations such as polynomials.

However, as an alternative, a look-up table could be used rather than further modelling, with the selection of the heat control data being performed by selecting from the most appropriate data already contained within the look-up table.

The heat source is preferably localised and may be applied at a single location within a region. Typically however a moveable heat source is used and the corresponding heat treatment data may in this case also define the motion of the heat source.

Depending upon the geometry of the workpiece, it will be appreciated that more than one region may be selected for the application of a heat treatment. If such regions are similar, although spatially separate, the same predetermined information can be used for determining an appropriate heat treatment to be applied in each region. However typically, predetermined information will be used for each region that is specific only to that region. A number of different heat treatments may therefore be applied to different regions within the workpiece, each heat treatment according to a specific determined relationship.

Typically the region(s) selected for determining the predetermined information are chosen by a user, such as an operator of the FEM, based upon details of the typical distortions produced during the fabrication of the workpiece. The selection of these regions is usually dependent upon the type of the distortion required and the geometry of the workpiece.

Although the heat treatments are preferably applied by a localised heat source, in general they will nevertheless produce a "heat affected zone" (HAZ) which is an area including and surrounding the region in which the heat source is applied, where the material has been significantly affected by the heating. When a number of distortions are determined and are applied by corresponding heat treatments to a number of regions of the workpiece, these regions are preferably arranged such that their heat affected zones are spatially separated. Preferably therefore, there is no overlap between heat affected zones.

The overlap of such heat affected zones may also be modelled if necessary although this is more complex. The use of spatially separated heat affected zones ensures that each heat treatment may be treated as distinct and any distortions produced will not directly interact with those produced in other heat affected zones. This greatly simplifies the step of determining the combination of heat treatments to apply in order to produce the desired distortions.

The two or more heat treatments to be applied are typically determined automatically, based upon data representing the initial configuration of the workpiece (using data from measurements), its desired configuration and the predetermined information. Generally an iterative computational method is used to perform this function, resulting in a calculation of the appropriate heat control data.

Preferably the steps of obtaining the predetermined information relating the heat treatments of the workpiece to the resultant distortions, and of determining the distortion to be applied to the region(s) of the workpiece, are each performed by a suitably programmed computer.

The invention is not limited to any particular workpiece geometry. However, it is particularly advantageous for use with workpieces having hollow or partially enclosed profiles since these are more difficult to distort by conventional means and their geometry is particularly suited to the generation of thermal gradients upon which the heat distortion effect relies.

Typically the workpiece is entirely metallic although laminated structures including at least one thermal barrier component can be used. Such thermal barriers provide the ability to obtain thermal gradients across workpieces of smaller dimension or high thermal conductivity.

In accordance with a second aspect of the present invention we provide apparatus for distorting a workpiece comprising:

a store for retaining predetermined information relating heat treatments of the workpiece to resultant distortions;

a processor for determining distortions to be applied to at least two regions of the workpiece to cause the workpiece to adopt a desired configuration, and for using the determined distortions and the predetermined information to obtain or generate heat control data defining corresponding heat treatments which, when applied to corresponding regions of the workpiece, will cause the determined distortion in the workpiece, wherein the heat control data and the determined distortions are related by the equation AX=B, where B is a vector describing the determined distortions according to the heat treatments, X is a vector representing the heat control data and A is a matrix of elements representing the predetermined information; and a controllable heat source for applying the defined heat treatment to the at least one region of the workpiece to produce the determined distortions.

Preferably the apparatus further comprises a monitoring device for determining an initial configuration of the workpiece.

The monitoring device may take any suitable form and use any appropriate monitoring method, for example a contact or non-contact method. Preferably it is an optical device such as a digital optical laser sensing device. Typically the monitoring device is also moveable and may include a fully automatic robot capable of multiple axial rotations. Alternatively, it can be a simpler device when just single or two-dimensional translations are desired.

When the initial configuration of the workpiece is determined, the processor is typically arranged to determine the distortion to be applied in accordance with the initial determined configuration.

Preferably the predetermined information held within the store is also generated using a processor. This processor may be the same processor as used for determining the distortion to be applied to the workpiece.

However, preferably the apparatus further comprises a second processor arranged to generate the predetermined information. This is because a customer may wish to use the apparatus as a "black box" and may have little knowledge of how the predetermined information is obtained or generated. In this case a supplier will be responsible for generating the predetermined information and tailoring it to the particular application required by the customer.

If the customer is interested in correcting deviations in a particular type of workpiece, then preferably the customer initially provides to the supplier detailed information describing the workpiece along with typical distortions. The predetermined information is then generated by the supplier using the second processor, which for example forms part of a high performance computer workstation. The supplier may therefore provide the customer with the predetermined information, or the heat control data itself for the application in question, as a database.

In a system having two separate processors as above, the predetermined information may be transferred from the supplier to the customer using a suitable communication medium such as the Internet, or alternatively can be provided on a disc or CD-ROM.

The heat source may take a variety of forms and in general is a point, line or area source although this may to some extent depend upon the method by which the heat is applied. For example, preferably the heat source is a laser which is particularly suitable for point source heat application, or an induction heating device where more generalised area heating may be achieved.

Preferably the heat source is equipped with a suitable drive means arranged to move the heat source with respect to the workpiece. In this way more complicated heat treatments may be applied such as the scanning of a laser beam along a suitable predetermined path in order to produce the desired distortion.

In additional to laser and induction heating methods, other possible heat sources include welding heat sources such as TIG and MIG apparatus, YAG and $CO_2$ lasers, plasma-arcs and oxy-acetylene burners.

BRIEF DESCRIPTION OF THE DRAWINGS

An example of a method and apparatus according to the present invention will now be described with reference to the accompanying drawings, in which.

DESCRIPTION OF PREFERRED EMBODIMENTS

Figure 1:
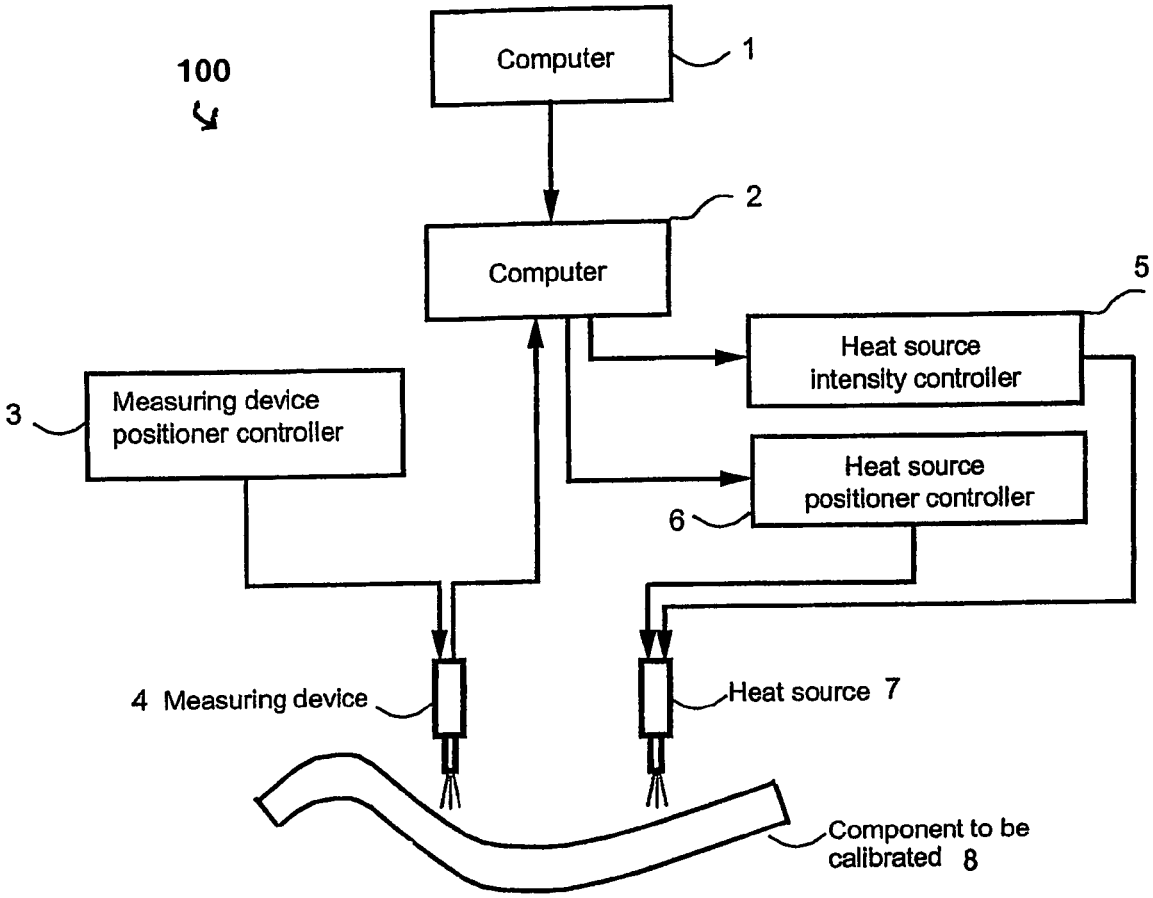
FIG. 1 is a block diagram of a system according to a first example.

FIG. 1 is a schematic block diagram of a heat distortion system generally indicated at 100. A modelling computer 1 is provided for modelling the expected distortion behaviour of a workpiece 8 due to various applied heat treatments. The modelling computer 1 may take any suitable form and in this case is a high performance workstation equipped with conventional devices such as a keyboard, storage devices such as hard disc drives and optical disc drives, along with internal ROM and RAM.

The modelling computer 1 is used to execute conventional modelling software entitled "WELDSIM", which is a finite element model (FEM) application. The modelling computer 1 is in the form of a high performance computer due to finite element modelling being a processor intensive technique.

As will be described later, data resulting from the modelling are passed from the modelling computer 1 to a control computer 2. In the present case, the modelling computer 1 is located remotely from the control computer 2 and information is passed between them through an Internet connection.

As shown in FIG. 1, the control computer 2 is connected to a moveable measuring device 4 arranged to perform a topological scan of the workpiece 8. The measuring device 4 is operated under the control of a measuring device position controller 3. In the present example the measuring device 4 is a digital optical laser sensing device. Such devices are commercially available and can provide fast and accurate measurement of three-dimensional surfaces of components of all sizes. The measuring device 4 is moveable within a two-dimensional horizontal plane and measures the position of the workpiece surface in a direction normal to this plane, that is vertically. The topological measurements are converted into topological data which are passed to the control computer 2 for analysis.

The control computer 2 also controls a moveable heat source 7 which in the present example is a high power diode laser mounted to a multi-axial robot. The movement of the heat source 7 is effected by a position controller 6 to which the heat source is connected, the position controller 6 being under the control of the control computer 2.

The amount of heating of the workpiece 8 by the heat source 7 is controlled by the control computer 2 using a corresponding intensity controller 5.

For some heat sources the heat distribution on the surface of the workpiece 8 can be relatively accurately controlled, while other heat sources only allow the total heat intensity to be adjusted. The use of a laser in the present example allows accurate control over the heating of the workpiece 8. The intensity of the diode laser and the speed with which the laser is moved over the workpiece 8 controls the heat input into the workpiece, which in turn controls the maximum temperature attained.

Example methods of performing the invention will now be described.

In the first example, a workpiece is formed from an age-hardening 6082 aluminium alloy in the initial temper condition T6 (artificially aged to peak strength). Equally any aluminium alloy could be used. The workpiece is produced by extrusion and takes the form of a rectangular hollow aluminium alloy component. This has cross-sectional dimensions 200 millimeters in width, 40 millimeters in height, with a wall thickness of 2 millimeters. The length of the workpiece is much longer than each of these dimensions, for example a number of metres, although the precise length is of little importance in this example. A length of 1000 millimeters is used in the modelling steps described below. It is the distortions introduced within the workpiece by the extrusion process that are desired to be corrected.

Figure 2:
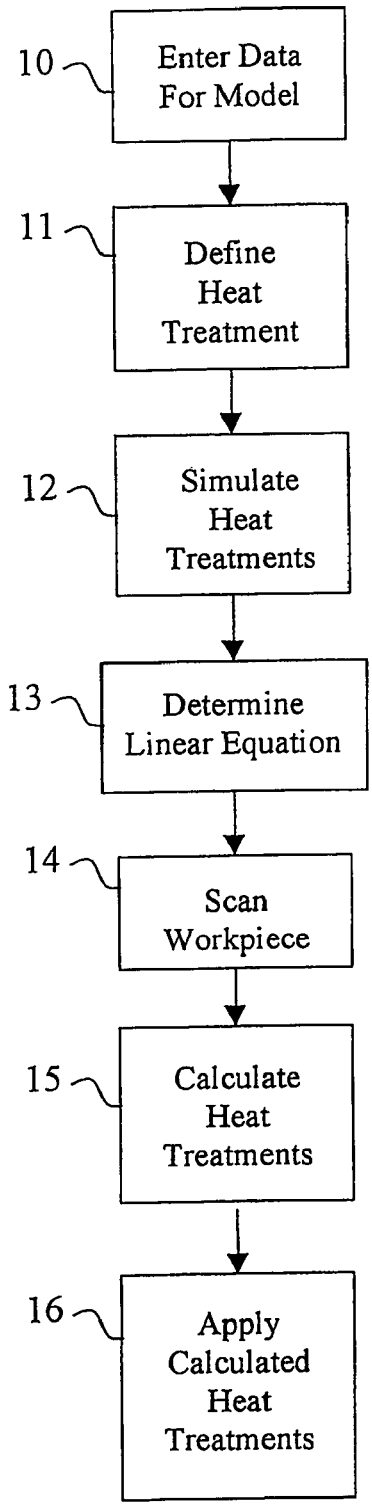
FIG. 2 is a flow diagram of a method of the first example.

Referring to FIG. 2, accurate modelling of the behaviour of the workpiece 8 (the extruded section) is firstly performed.

Data describing the workpiece 8 are entered into the WELDSIM model running upon the modelling computer 1 at step 10. These data include the geometrical form of the extruded workpiece 8 described above, along with other physical and thermal data describing the type of alloy, for example its chemical composition, and its temper condition. In addition to these data, modelling parameters are defined in accordance with standard FEM techniques, such as those used in defining an appropriate mesh to represent the workpiece 8.

Once the workpiece has been defined fully in WELDSIM, a heat treatment is selected to be applied to the model workpiece at step 11. This involves the selection of parameters defining the heat treatment and also the region of the workpiece to which this is applied. In the present case a simulation is chosen in which the heat source 7 is passed across one of the two larger faces of the workpiece 8 in a direction substantially normal to its axial length.

The type of heat source selected is one which accurately represents the behaviour of the heat source 7 (diode laser) of the system 100. Here a moving distributed heat source is assumed to be applied at the upper surface of the component starting at one edge and moving across the surface in a transverse direction with a given velocity.

In this example the heat source is represented by a two-dimensional Gaussian distribution with a total intensity of 700 joules per second, wherein 95% of the heat flux is deposited within a radius of 3 millimeters on the surface of the model workpiece. The travel speed of the heat source in the transverse direction is selected as 20 millimeters per second.

The selection of the values for the various heat treatment variables, including the region of the model workpiece to which the heat treatment is applied, will generally be made based upon experience and an iterative approach on the part of the model operator. In most cases the selection of these will be guided by a knowledge of the magnitude and location of typical distortions produced during fabrication of the real workpiece 8.

The heat treatment simulation is then performed using WELDSIM at step 12. This involves the simulation of a single pass of the heat source across the face of the model workpiece 8' which is initially at room temperature. WELDSIM models the heat flow within the workpiece and calculates the resultant local thermal expansion, stress and plastic flow effects due to the heat treatment. This causes distortions within the model workpiece 8' both during the heat treatment and afterwards when the workpiece has cooled to room temperature.

Figure 3A:
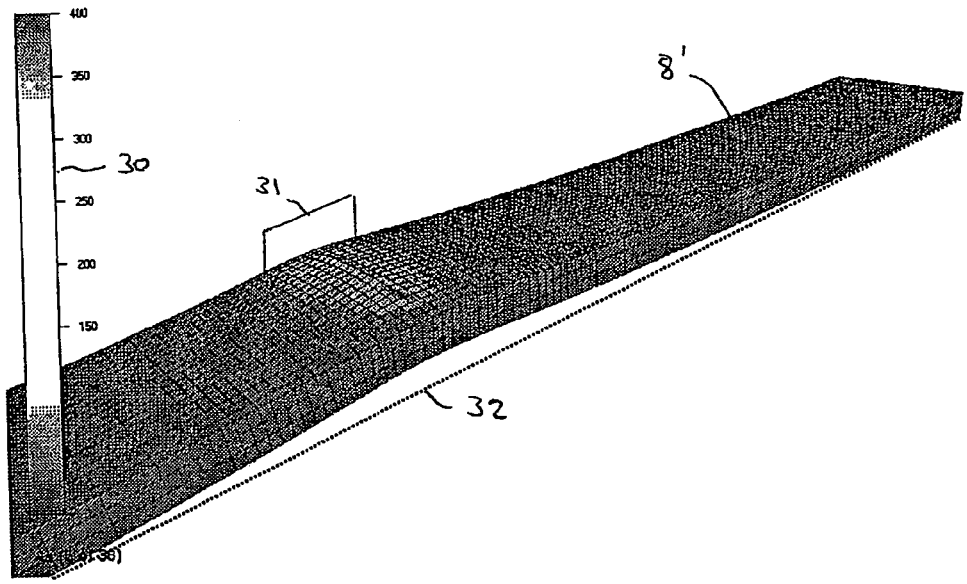
FIG. 3*a* is an illustration of the predicted behaviour of the workpiece during a heat treatment.

FIG. 3*a* shows the calculated form of the model workpiece 8' approximately half way through the heat treatment cycle. The temperature in degrees Celsius is indicated by the scale bar 30. It can be seen that during the heat treatment, the region of the workpiece to which the heat treatment is applied bends on either side away from the heat source 7 due to thermal expansion and plastic flow in the upper surface. The figure also schematically shows a heat affected zone (HAZ) 31 in which significant thermal effects are experienced by the alloy. Accordingly the regions of the workpiece 8' outside the heat affected zone can be thought of as substantially unaffected by the heat treatment and remain at substantially room temperature during the thermal cycle.

However, the heat input and travel speed of the heat source 7 causes the maximum temperature within the heated region to be approximately 500° C. at positions directly beneath the travelling heat source. This ensures that local melting does not take place (as the solidus temperature is about 580° C. for this alloy) although there is sufficient heating to cause significant plastic flow and resultant distortions are produced.

Figure 3B:
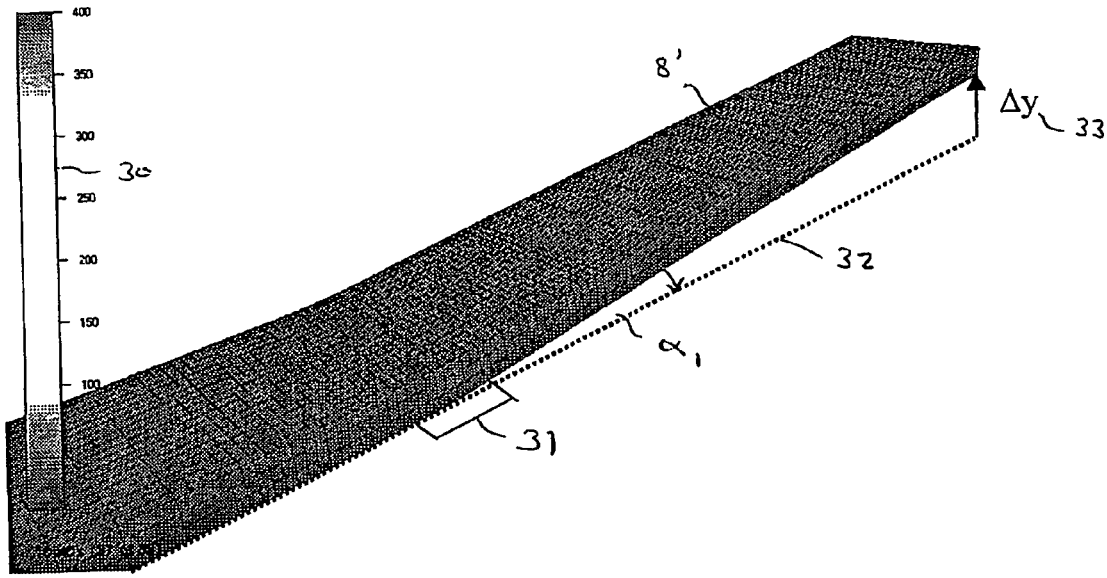
FIG. 3*b* is an illustration of the predicted behaviour of the workpiece after the heat treatment.

The final form of the workpiece 8' is shown in FIG. 3*b* and it can be seen that all parts of the alloy are at room temperature. It should be noted that, due to cooling effects, the distortion of the workpiece is now opposite to that which occurred during the heat treatment, the dotted line 32 indicating the original form of the workpiece 8' prior to the heat treatment.

Vertical deviations ΔY 33 with respect to the original configuration of the workpiece 32 can therefore be defined. As distortion only occurs within the heat affected zone 31, the magnitude of the deviation ΔY will depend upon the distance along the workpiece 8' from the heat affected zone 31, of the point at which this deviation ΔY is measured.

For efficiency, rather than storing data representing ΔY values at a number of points along the workpiece 8', instead an angle $\alpha_1$ is defined (see FIG. 3*b*) which describes the angle between the upper surfaces of the workpiece 8' with respect to the heat affected zone 31. Using this angle, values for ΔY can be calculated for points at any distance from the HAZ 31. The values of $\alpha_1$ and the heat input $Q_1$ are stored for later use.

Returning to FIG. 2, at step 12 a number of simulated heat treatments are performed upon workpiece 8', each having the same initial condition, by systematically varying the heat intensity whilst keeping other heat treatment variables constant (such as the travel speed of the heat source 7). The second heat treatment produces a resultant distortion angle $\alpha_2$ with a heat input $Q_2$. Further heat treatments up to a number "n" result in the storage of further data up to $\alpha_n$ and $Q_n$.

The heat treatment simulations at step 12 therefore produce a heat treatment data set simulating the distortions produced within the selected region containing the heat affected zone 31 and the distortions produced.

These data are then modelled by fitting them to an appropriate relationship at step 13. In the present case, a suitable relationship is found to be a linear equation, although depending upon the form of the data more complex relationships may be required in other cases.

The linear equation relates a general heat input Q to a general angle of distortion α produced. This angle α can be further used to deduce distortions ΔY at various displacements away from the heat affected zone 31. This is particularly important in the calculation of the heat treatments to be applied to more than one region of the real workpiece 8.

Details of the linear equation derived in step 13 are then passed to the control computer 2 (FIG. 1).

In the present example, the workpiece has a constant cross-section along its length and therefore, providing sufficient spatial separation is achieved between heat affected zones (i.e. such that they do not overlap), a number of regions in parallel can be defined and distortions having an independent effect can be applied to each. A similar equation as deduced in step 13 is therefore applicable to each region.

At step 14 of FIG. 2 the control computer 2 activates the measuring device position controller 3 to perform a scan of the surface of the extruded workpiece 8. The workpiece contains a number of distortions and data concerning these distortions in terms of surface displacements are measured by the measuring device 4 in step 14. The system is arranged such that these surface displacement measurements are aligned with the distortion values ΔY as determined during the modelling.

The measured displacements data are then retained in the control computer 2 within a store. The control computer 2 also retains data relating to the desired configuration of the workpiece without the distortions and this desired configuration data can be compared with that measured by the measuring device 4 to determine values of ΔY at any position within the workpiece 8.

Depending upon the complexity of the distortions, a number of regions within the workpiece can be defined in which to apply the heat treatments so as to correct them. These corrective heat treatments may be applied simultaneously at each point or alternatively they may be applied consecutively using a single heat source. Each method assumes that there is no interaction between each heat treatment.

In most cases the regions of the workpiece for heat treatment are predefined. Of course a large number of these may be defined and only a few used where relatively simple distortions are required.

In the present example 9 regions are preselected by a user, based upon experience of the distortions produced during extrusion. It is then desirable to determine a suitable combination of heat treatments to apply to these regions in order to produce an effective distortion correction. Here the best solution to this problem is the combination of heat treatments which will result in the workpiece 8 adopting a straight configuration (with no vertical distortions).

Figure 4:
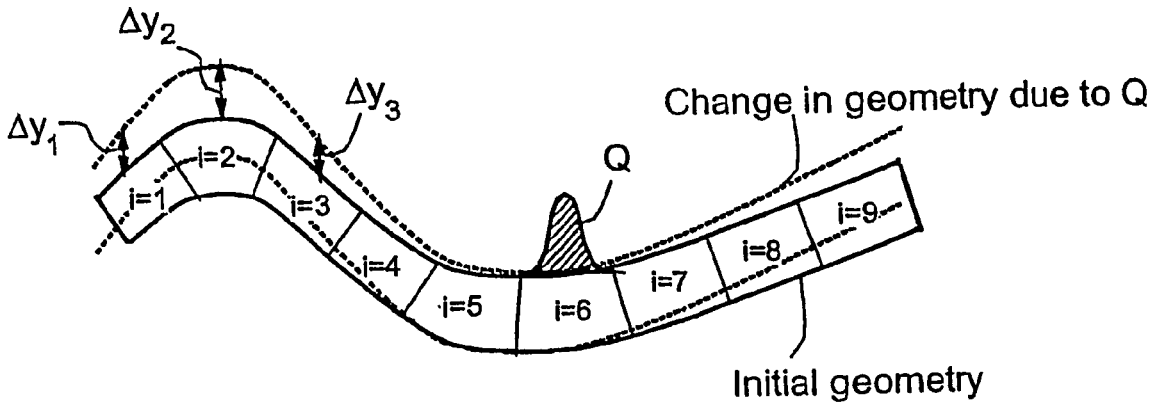
FIG. 4 shows the influence of a heat treatment upon the measured distortion values.

Although the heat treatments in each region are effectively independent of each other, they do each influence the vertical displacements of the workpiece 8 within each other region. This is illustrated in FIG. 4 where the nine separate regions of the workpiece are denoted by a region label. "i". When the heat input Q is applied to the region i=6 with the workpiece 8 in some initial configuration (denoted by solid lines), a vertical displacement in each of the other regions is produced.

These are denoted $\Delta y_1$, for region i=1 and so on, with the largest displacements being found in the regions furthest away from the region i=6. The Gaussian form of the heat input Q is also shown in FIG. 4.

The resultant configuration is shown by dotted lines. Each heat treatment therefore produces a vertical displacement in each other region and, considering a single region, the total distortion to be caused in each region is a superposition of the contributions from every other region.

Assuming the linear relationship between the distortion angle and the heat treatment due to step 13, and assuming a linear relationship between the vertical deflections and the displacements from the heat source for each region, it is possible to collect the individual contributions to the vertical deflections from the different heat sources into a 9 row by 9 column matrix A:

$$A = \begin{bmatrix} \frac{\partial \Delta y_1}{\partial Q_1} & \frac{\partial \Delta y_1}{\partial Q_2} & \cdots & \cdots & \frac{\partial \Delta y_1}{\partial Q_9} \\ \frac{\partial \Delta y_2}{\partial Q_1} & \frac{\partial \Delta y_2}{\partial Q_2} & \cdots & \cdots & \\ \cdots & \cdots & \cdots & & \\ \cdots & & & \cdots & \\ \frac{\partial \Delta y_9}{\partial Q_1} & & & & \frac{\partial \Delta y_9}{\partial Q_9} \end{bmatrix}$$

Where: $-\frac{\partial \Delta y_1}{\partial Q_2}$ represents the contribution to the vertical distortion Δy in region i=1 from the heat source Q applied in region i=2. $Q_1$ to $Q_9$ define the heat treatments applied to each of the regions i=1 to i=9 of the workpiece 8, with $\Delta y_1$ to $\Delta y_9$ denoting the distortions in each of these regions respectively.

As the heat treatment contributions can be individually superimposed, the heat inputs $Q_1$ to $Q_9$ for the heat treatments in each corresponding region can be represented as a vector X, and the total measured distortions in each region, $\Delta ym_1$ for region i=1 and so on, can be similarly represented as a second vector B, thereby describing the deviations between the desired and the actual geometry. This gives:

$$X = \begin{bmatrix} Q_1 \\ Q_2 \\ \cdots \\ \cdots \\ Q_9 \end{bmatrix} \text{ and } B = \begin{bmatrix} \Delta ym_1 \\ \Delta ym_2 \\ \cdots \\ \cdots \\ \Delta ym_9 \end{bmatrix}$$

The above matrix and equations can therefore be represented by the equation:

$$AX=B \quad [1]$$

An exact solution of Equation 1 may not sometimes be possible to obtain, particularly if the required distortions are large and the heat-induced distortions are of insufficient magnitude to produce them without an unreasonably high number of heated regions. One or more of the calculated Q values within the vector X may also be outside the range covered by the heat source although corresponding restrictions can be imposed upon the calculated heat source intensities.

However, a set of values $Q_1$ to $Q_9$ can be calculated which, when applied to each of the regions of the workpiece, will make the overall deviations between the desired geometry and the workpiece geometry significantly smaller. This can be done by minimising the parameter S, given by Equation 2 below rather than seeking an exact solution to Equation 1.

$$S=\Sigma_i(\Delta y_i-\Delta ym_i)^2 \quad [2]$$

Using the distortions measured from the workpiece in step 14 values for $\Delta ym_1$ to $\Delta ym_9$ can be evaluated by the control computer 2 and Equation 1 solved to produce values for the heat input values $Q_1$ to $Q_9$ for the heat treatments. This equation can be solved by various conventional and numerical techniques such as the Gauss-Seidel method.

In this example an iterative approach is used (step 15). During this process the matrix A is populated using the linear equation determined in step 13 and data describing the relative displacements of the regions "i".

During the final step 16, the control computer 2 operates the intensity controller 5 and the position controller 6 so as to control the heat source 7 to apply each heat treatment to the regions "i" in turn using the determined heat inputs $Q_1$ to $Q_9$.

A second example relating to in-plane distortions of a rectangular aluminium frame is now described with reference to FIG. 5.

This second example illustrates how a frame structure, that deviates from a desired rectangular configuration (for example due to welding), can be adjusted according to the present invention. In the present case, it is assumed that the variable defining the heat treatment is the total heat input vector Q(J). As shown in FIG. 5, the frame is divided into an appropriate number of regions that will be subjected to local heating. In this case four such regions are chosen, corresponding to the mid-position of each member of the frame.

Figure 5:
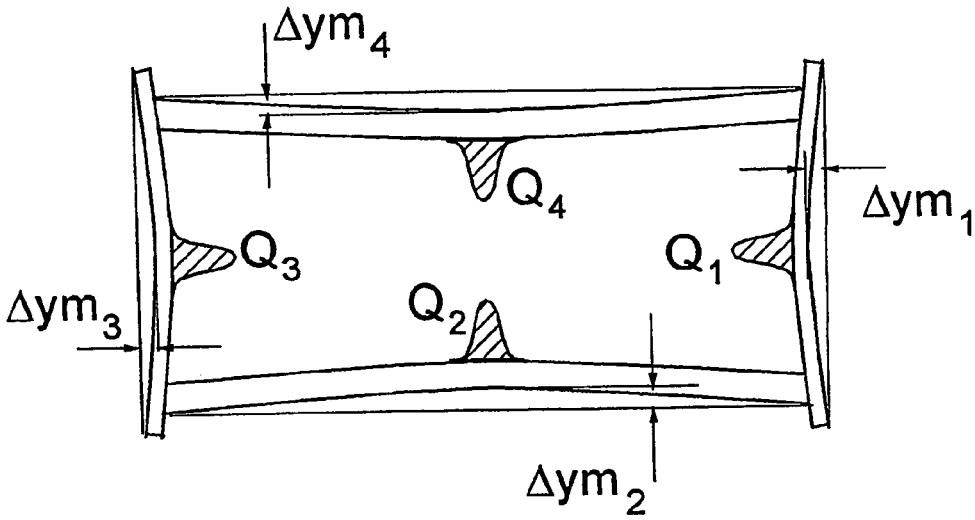
FIG. 5 illustrates the distortion of a workpiece according to a second example.

FIG. 5 also shows the deviations between the desired (dashed lines) and actual (solid lines) configuration of the frame as defined by $\Delta ym_1$, $\Delta ym_2$, $\Delta ym_3$, and $\Delta ym_4$. The positions of the four unknown heat sources with an associated heat input $Q_1$, $Q_2$, $Q_3$, and $Q_4$, respectively are also indicated.

These heat sources act to adjust the frame to the desired rectangular configuration if their magnitude and position are, correctly selected. If the calculations result in one or more of these heat inputs being negative, it means that these sources should be placed at the opposite side of the member relative to the positions shown in FIG. 5.

It is assumed here that the frame is completely "flat", that is, there are no "out of plane" distortions to be corrected. Since the frame possesses a high degree of symmetry the number of simulations required is small. However, the principles described here can be used for more complex geometrical shapes including non-symmetric frame structures.

The method is similar to that described with reference to FIG. 2 and involves carrying out a series of systematic FE-simulations in order to obtain the matrix A described earlier. In these simulations, the effect of varying the intensity for each separate source with respect to the resulting distortions $\Delta y_1$, $\Delta y_2$, $\Delta y_3$, and $\Delta y_4$ is recorded. As in the first example, a linear relationship is used to fit the data. An advantage of the matrix equation (AX=B) method, is that only a small number of simulations are required and these are made at the positions within the workpiece where the heat treatments are to be applied. A small number of simulations (for example 3 to 5) have been found to be sufficient in many cases to produce a relationship leading to accurate results.

Due to the symmetric nature of the workpiece in this example, only two separate relationships are required to be determined from the simulations, one relationship relating to $Q_1$ and $Q_3$, and the other to $Q_2$ and $Q_4$. Therefore several elements within the matrix A will be identical, which reduces the number of calculations significantly. Hence, the 16 elements of the matrix A in the present example is given as follows, where standard matrix notations are applied:

$$a_{11}=a_{33}=1.4\times10^{-5}\ \text{mm/J}$$

$$a_{12}=a_{14}=a_{32}=a_{34}=-9.0\times10^{-6}\ \text{mm/J}$$

$$a_{13}=a_{31}=5.0\times10^{-7}\ \text{mm/J}$$

$$a_{21}=a_{23}=a_{41}=a_{43}=-1.0\times10^{-5}\ \text{mm/J}$$

$$a_{22}=a_{44}=3.2\times10^{-5}\ \text{mm/J}$$

$$a_{24}=a_{42}=5.0\times10^{-7}\text{mm/J}$$

The parameters $\Delta ym_1$ to $\Delta ym_4$ define the deviation between the desired rectangular configuration and the actual configuration of the frame. Table 1 below shows the values that were chosen for these deviations in the present example, and the corresponding calculated heat contributions $Q_1$, $Q_2$, $Q_3$ and $Q_4$ that cause the frame to adopt a rectangular shape.

TABLE 1

| | Position 1 | Position 2 | Position 3 | Position 4 |
|---|---|---|---|---|
| Δym (mm) | 0.4 | 0.2 | 0.3 | 0.1 |
| Q (kJ) | 130.0 | 84.1 | 122.8 | 80.9 |

As can be seen, $Q_1$, $Q_2$, Q3 and $Q_4$ (corresponding to the positions 1 to 4) are all positive, which means that the directions are the same as in FIG. 5.

Figure 6A:
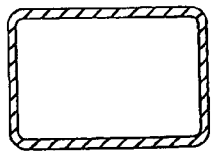
FIGS. 6A to 6D show example profiles of further workpieces.
Figure 6B:
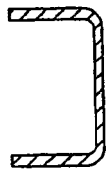
Figure 6C:
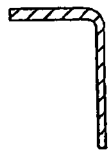
Figure 6D:
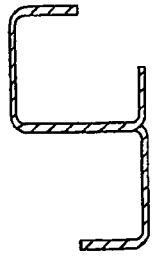

FIGS. 6A to 6D show other examples of typical non-planar workpiece profiles. In FIG. 6A a symmetrical rectangular "hollow" profile is illustrated as in the example above, having symmetry along two orthogonal axes. FIG. 6B has a single axis of symmetry and partially encloses a central region, the profile taking the form of three sides of a rectangle. The profiles shown in FIGS. 6C and 6D are non-symmetrical although they can similarly be thought of as partially enclosing "hollow" regions.

The present invention relies upon the ability to establish a thermal gradient within the workpiece during the heat treatment such that distortion is achieved by causing strains only in specific regions. In each case, the shape and dimensions of the workpiece and the material from which it is fabricated, influence the configuration and magnitude of the thermal gradients which can be achieved. The workpiece material, dimensions and shape also in turn determine the size and configuration of the distortions which can be achieved.

The present invention is therefore particularly suited to the distortion of workpieces having more complex geometries such as hollow or partially hollow (that is partially enclosed) extruded profiles. Single and multi-membered workpieces can each be subjected to the method of the invention, for example frame structures such as engine cradles and windshield frames for automobiles. As it is easier to generate a thermal gradient in a hollow or partially hollow profile, such profiles are advantageous for workpieces of high thermal conductivity materials such as aluminium and magnesium. The invention can be used to introduce distortions in such profiles in order to make corrections longitudinally or in their cross section.

In addition to metallic workpieces such as those fabricated from aluminium or steel alloys, other materials can be used in which a thermal gradient can be established. For example, a laminated structure containing one or more layers of a thermal barrier material can be used. In this case the barrier layer(s) should be chosen to prevent debonding at the interfaces, along with having a low thermal conductivity and a high melting point.

It should be noted that in each of the above examples described the positions where the heat is applied (for example the positions 1-4 in the second example) do not have to be the same as the positions where the deviations between the desired and actual configuration are registered.

There are also no restrictions on the number of geometrical positions that can be corrected on the workpiece. In the second example, four positions were corrected leading to a 4×4 matrix. Hence, the larger the number of positions to be corrected on the workpiece, the larger the number of elements within the matrix A.

The dimensional response from the heating of the structure does not have to be linear and therefore non-linear equations can be used. The elements $a_{ij}$ within the matrix A do not therefore have to be constants and can for example be a function of the applied heat contributions $Q_i$. However, the use of a linear relationship does simplify the process of obtaining a solution to the matrix equation 1 although numerical computation prevents this from being a significant problem.

The workpiece does not have to be symmetrical in any sense in order to perform the present invention, as illustrated by FIGS. 6C and 6D. Moreover, the cross section as well as the wall thickness of the structure can vary freely.

The examples described above deal with distortions in just one direction, that is one-dimensional correction. The distortions can also be performed in more than one dimension which allows for corrections of so called "out of plane" distortions of frames (workpieces).

In practical situations the workpiece may not have a constant cross-section along its length and as a result it will often be necessary to model the distortion behaviour of a number of regions of the workpiece individually rather than use one model in a number of such regions. The FEM technique can be readily applied to more complicated geometries of workpiece by the use of an appropriate mesh. It can also be extended to model microstructural changes which may occur for some alloys in response to heat treatment. A particular application of this would be advantageous in correcting distortions within steels or aluminium alloys as the heat treatment of these frequently causes microstructural modification with a resultant effect upon mechanical properties.

As suggested above, once the data has been obtained from the FEM it may be fitted to more complicated non-linear equations. This will result in the requirement of more complicated iterative processes to deduce a good fit of heat treatments to be applied to the various selected regions.

Potentially there is no limit to the number of regions which can be defined within a workpiece using this method. It is also perceived that interactions between heat affected zones could also be potentially modelled providing this is also done in the FEM simulation. In addition more complicated examples may also involve the simultaneous systematic variation of values for more than one heat treatment variable.

The methods described are generally applicable to suitable materials such as alloys. In general, although the maximum temperature will preferably be a large fraction of the solidus or melting point temperature of the metal, in principal temperatures sufficient to cause melting could also be used.

One example of the application of the method and system described, is in the correction of distortions within individual extruded members in the automotive industry. Such members include bumper beams, engine cradle components, windshield frames and space frame components. A second application is also in the correction of distortions within welded assemblies such as engine cradles, windshield frame and space frames.

The invention claimed is:

1. A method of distorting a workpiece comprising a non-planar profile, said method comprising:

selecting a desired configuration of the workpiece;

determining distortions to be applied to at least two regions of the workpiece to cause the workpiece to adopt the desired configuration;

using the determined distortions in accordance with predetermined information that relates heat treatments of the workpiece to resultant distortions, to obtain or generate heat control data defining heat treatments to be applied to corresponding regions of the workpiece, which will cause the determined distortions in the workpiece;

relating the heat control data and the determined distortions by the equation AX=B, where B is a vector describing the determined distortions according to the heat treatments, X is a vector representing the heat control data and A is a matrix of elements representing the predetermined information; and applying the defined heat treatments to the corresponding regions of the workpiece to produce the determined distortions.

2. A method according to claim 1, further comprising using a measuring device to determine an initial configuration of the workpiece.

3. A method according to claim 1, wherein the predetermined data are stored in a look-up table.

4. A method according to claim 1, wherein at least one of the heat treatment data and the distortion data are generated by modelling the application of heat treatments to the workpiece.

5. A method according to claim 4, wherein the modelling is performed using a finite elements technique.

6. A method according to claim 1, wherein the distortion data describes a distortion angle between two parts of the workpiece on opposing sides of a heat treated region.

7. A method according to claim 1 further comprising, determining at least one relationship between the heat treatment data and the distortion data, and representing the at least one determined relationship as the predetermined information.

8. A method according to claim 7, wherein the at least one determined relationship is an equation and wherein the matrix A comprises elements representing the derivatives of each equation.

9. A method according to claim 8, wherein the derivative elements are a function of the components of the vector X.

10. A method according to claim 8, wherein matrix A is of the form $$A = \begin{bmatrix} \frac{\partial \Delta y_1}{\partial Q_1} & \frac{\partial \Delta y_1}{\partial Q} & \cdots & \cdots & \frac{\partial \Delta y_1}{\partial Q_m} \\ \frac{\partial \Delta y_2}{\partial Q_1} & \frac{\partial \Delta y_2}{\partial Q_2} & \cdots & \cdots & \\ \cdots & \cdots & \frac{\partial \Delta y_k}{\partial Q_1} & & \\ \cdots & & & \cdots & \\ \frac{\partial \Delta y_n}{\partial Q_1} & & & & \frac{\partial \Delta y_n}{\partial Q_n} \end{bmatrix}$$

wherein $$\frac{\partial \Delta y_k}{\partial Q_l}$$

represents the contribution to the vertical distortion Δy in a kth region from the heat source Q applied to a jth region and wherein there are n heat sources.

11. A method according to claim 10, wherein each equation is linear and wherein each element of the matrix is a coefficient.

12. A method according to claim 1, wherein the heat treatment is applied by a movable heat source.

13. A method according to claim 1, wherein the heat treatment data defines at least one of the total heat input of the heat treatment, the intensity or intensity distribution of the heat source, the area over which the heat source is acting, and the travel speed or the time period during which the heat is applied.

14. A method according to claim 12, wherein the heat treatment data defines a motion of the heat source.

15. A method according to claim 1, wherein a number of distortions are determined and are applied by corresponding heat treatments to a number of regions of the workpiece, wherein the heat treatment in each region produces a corresponding heat affected zone, and wherein the regions are arranged such that their heat affected zones are spatially separated.

16. A method according to claim 1, wherein the distortions are applied to correct distortions introduced into the workpiece during fabrication of the workpiece.

17. A method according to claim 1, wherein the method is adapted to distort a workpiece formed from an aluminium alloy.

18. A method according to claim 1 further comprising using a computer program recorded on a computer-readable medium comprising program code means to facilitate said selecting a desired configuration, said determining distortions, said using the determined distortions, said relating the heat control data and the determined distortions by the equation AX=B, and said applying the heat treatments.

19. A method according to claim 1 further comprising using a computer program product comprising program code means stored on a computer readable medium that is run on a computer for facilitating said selecting a desired configuration, said determining distortions, said using the determined distortions, said relating the heat control data and the determined distortions by the equation AX=B, and said applying the heat treatments.

20. A method according to claim 1 wherein the method is adapted to distort the workpiece, wherein the workpiece has a hollow or a partially enclosed profile.

21. A method according to claim 1 wherein the method is adapted to distort the workpiece, wherein the workpiece is substantially metallic.

22. A method according to claim 1 wherein the method is adapted to distort the workpiece, wherein the workpiece has a laminated structure including at least one thermal barrier component.

23. A method according to claim 1 further comprising storing the predetermined information or heat control data in a database.

24. An apparatus for correcting a geometry of a workpiece comprising a non-planar profile to compensate for variations caused in preceding process steps, in order to ensure a final geometry of the workpiece within predefined tolerances, said apparatus comprising:

means for measuring an initial topology of the workpiece, wherein measurements obtained by said means for measuring are used in determining whether the configuration of the workpiece is within predefined tolerances;

a store for retaining predetermined information relating heat treatments of the workpiece to resultant distortions;

a processor for determining distortions to be applied to at least two regions of the workpiece to cause the workpiece to have a desired configuration within the predefined tolerances to compensate for variations caused in the preceding process steps, and that uses the determined distortions and the predetermined information to obtain or generate heat control data defining corresponding heat treatments which, when applied to corresponding regions of the workpiece, will cause the determined distortion in the workpiece such that the workpiece obtains the desired configuration within the predefined tolerances, wherein the heat control data and the determined distortions are related by the equation AX=B, where B is a vector describing the determined distortions according to the heat treatments, X is a vector representing the heat control data and A is a matrix of elements representing the predetermined information; and a controllable heat source for applying the defined heat treatment to the at least one region of the workpiece to produce the determined distortions.

25. An apparatus according to claim 24, wherein said means for measuring the initial topology of the workpiece comprises an optical monitoring device.

26. An apparatus according to claim 24, further comprising a second processor operable to model the application of heat treatments to the workpiece and to generate the predetermined information.

27. An apparatus according to claim 24, further comprising drive means arranged to move the heat source with respect to the workpiece.

28. An apparatus according to claim 24, wherein the heat source is a laser or an induction heat source.

29. An apparatus according to claim 24, wherein the heat source is substantially a line source.

* * * * *